US012351273B2

(12) United States Patent
Hill et al.

(10) Patent No.: US 12,351,273 B2
(45) Date of Patent: Jul. 8, 2025

(54) TOWER WITH ELECTRIC ACTUATORS

(71) Applicant: Xtreme Marine Corporation, Knoxville, TN (US)

(72) Inventors: William C. Hill, Knoxville, TN (US); Benjamin Girard Harder, Knoxville, TN (US)

(73) Assignee: XTREME MARINE CORPORATION, Knoxville, TN (US)

( * ) Notice: Subject to any disclaimer, the term of this patent is extended or adjusted under 35 U.S.C. 154(b) by 410 days.

(21) Appl. No.: 17/840,084

(22) Filed: Jun. 14, 2022

(65) Prior Publication Data

US 2023/0008845 A1 Jan. 12, 2023

Related U.S. Application Data

(60) Provisional application No. 63/218,670, filed on Jul. 6, 2021.

(51) Int. Cl.
*B63B 17/02* (2006.01)

(52) U.S. Cl.
CPC ..... *B63B 17/02* (2013.01); *B63B 2017/026* (2013.01)

(58) Field of Classification Search
CPC ..... B63B 17/00; B63B 17/02; B63B 17/023; B63B 2017/026
See application file for complete search history.

(56) References Cited

U.S. PATENT DOCUMENTS

| | | | |
|---|---|---|---|
| 4,926,782 | A | 5/1990 | Lacy |
| 5,918,613 | A | 7/1999 | Larson |
| 6,026,761 | A | 2/2000 | Parniske et al. |
| 6,209,477 | B1 | 4/2001 | Biedenweg |
| 6,257,261 | B1 | 7/2001 | Johnson |
| 6,327,993 | B1 | 12/2001 | Richens, Jr. |
| 6,666,159 | B2 | 12/2003 | Larson et al. |
| 6,691,637 | B1 | 2/2004 | Smith et al. |
| 6,755,332 | B2 | 6/2004 | Crane et al. |
| 6,799,529 | B1 | 10/2004 | Willis |
| 6,945,188 | B2 | 9/2005 | Eck et al. |
| 6,983,716 | B1 | 1/2006 | Ankney et al. |
| 7,219,617 | B2 | 5/2007 | Metcalf |
| 7,392,758 | B2 | 7/2008 | Metcalf |
| 7,438,015 | B1 | 10/2008 | Schwindaman |
| 7,798,089 | B2 | 9/2010 | McKeand |
| 7,895,964 | B2 | 3/2011 | Russikoff |
| 7,950,342 | B2 | 5/2011 | Russikoff |
| 8,025,194 | B2 | 9/2011 | Jesewitz |
| 8,297,484 | B2 | 10/2012 | Jesewitz et al. |
| 8,495,967 | B2 | 7/2013 | Williams et al. |
| 8,522,709 | B2 | 9/2013 | Williams et al. |
| 8,567,651 | B2 | 10/2013 | Jesewitz |
| 8,752,498 | B1 | 6/2014 | Schwindaman et al. |

(Continued)

*Primary Examiner* — Scott A Browne
*Assistant Examiner* — Jisun Choi
(74) *Attorney, Agent, or Firm* — Price Heneveld LLP

(57) ABSTRACT

A foldable watersports tower for a boat includes a pair of legs pivotally mounted to the boat, each leg having an electronic leg actuator operable to pivot the leg between an upright orientation and a lower orientation; a cross-piece extending between the legs; a roof mount pivotally mounted to the legs; a roof mounted to the roof mount; and a roof frame actuator connected between portions of the cross-piece and portions of the roof mount.

12 Claims, 9 Drawing Sheets

(56) References Cited

U.S. PATENT DOCUMENTS

| | | | | |
|---|---|---|---|---|
| 9,114,854 | B2 | 8/2015 | Williams et al. | |
| 9,114,855 | B2 | 8/2015 | Nemeth | |
| 9,139,259 | B2 | 9/2015 | Williams et al. | |
| 9,434,451 | B1 | 9/2016 | Ostmeyer et al. | |
| 9,926,045 | B1 | 3/2018 | Ostmeyer et al. | |
| 11,345,444 | B2 | 5/2022 | Mills et al. | |
| 2005/0194414 | A1 | 9/2005 | Lynch | |
| 2014/0261144 | A1* | 9/2014 | Nemeth | B63B 17/02 114/361 |
| 2022/0234688 | A1* | 7/2022 | Messick | B63J 3/00 |

* cited by examiner

TOWER WITH ELECTRIC ACTUATORS

CROSS REFERENCE TO RELATED APPLICATION

This application claims priority to co-pending U.S. Provisional Application Ser. No. 63/218,670 filed Jul. 6, 2021, entitled "Tower with Electric Actuators," the entire contents of which is incorporated herein by reference.

FIELD

The present disclosure relates to towers for boats. More particularly, the disclosure relates to a foldable tower for boats that utilizes electronic actuators to fold the tower between lowered and elevated positions.

BACKGROUND AND SUMMARY

Improvement is desired in the provision of tops for boats. In particular, what is desired is a folding watersports tower incorporating a sun or other protective roof structure that is foldable by use of electronic actuators to provide different configurations while maintaining the sun cover or roof structure in a constant attitude.

In one aspect, the disclosure provides a foldable watersports tower for a boat. The tower includes a pair of legs pivotally mounted to the boat, each leg having an electronic leg actuator operable to pivot the leg between an upright orientation and a lower orientation; a cross-piece extending between the legs; a roof mount pivotally mounted to the legs; a roof mounted to the roof mount; and a roof frame actuator connected between portions of the cross-piece and portions of the roof mount.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein:

FIG. 6 shows the raised orientation and FIG. 7 shows the lowered orientation.

FIG. 8 shows the rear auxiliary roof section retracted for storage and FIG. 9 shows the rear auxiliary roof section extended.

DETAILED DESCRIPTION

Figure 1:
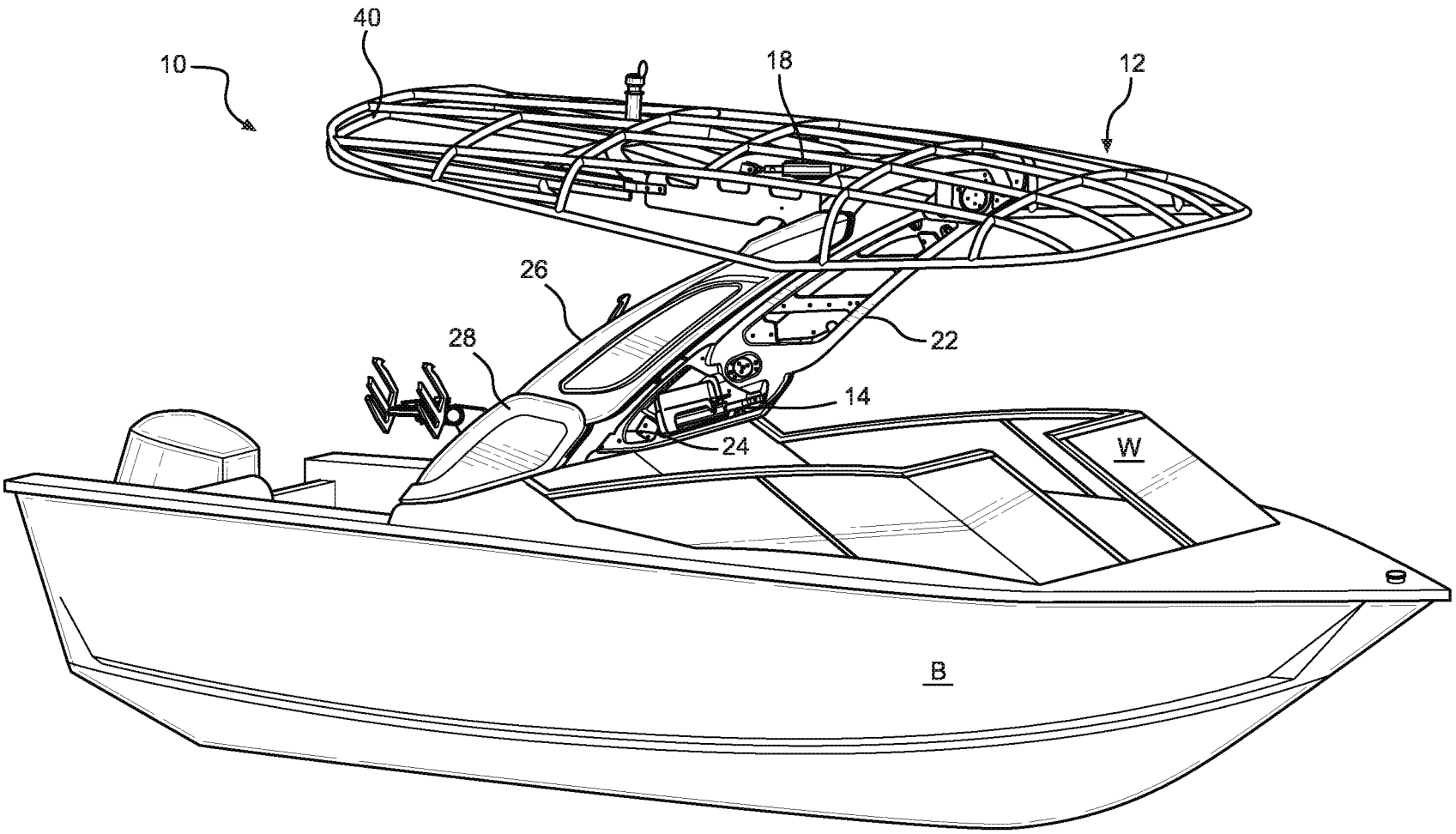
FIG. 1 is a perspective view of a foldable watersports tower according to the disclosure mounted on a boat and oriented in an elevated or erected orientation.

With reference to the drawings, there is shown a foldable watersports tower 10 according to the disclosure that is mountable on a boat B having a windshield W. The tower 10 is configured to serve as both a watersports tower and to provide a roof. The tower 10 includes a roof frame 12 for supporting a Bimini cover or other sun cover as may be provided by fabric or panels onto the roof frame 12. The roof frame 12 may also be configured to provide a cargo/storage rack.

The structural components of the tower 10 are preferably made of metal, such as aluminum and tubular aluminum, and/or steel. Accessories, such as wakeboard racks and audio speakers may be attached to the tower 10.

The tower 10 is advantageously configured to be folded between an erected orientation (FIGS. 1 and 3) and a stowed orientation (FIGS. 2 and 4) and to maintain the roof frame 12 substantially level in the erected orientation, the stowed orientation, and at all orientations therebetween.

The tower 10 is also advantageously configured to include electrical leg actuators 14 and 16, and an electrical roof frame actuator 18. The electrical actuators 14 and 16 may be substantially identical to one another. Each of the actuators 14-18 is preferably a linear actuator and includes an extending/retracting shaft, such as shaft 14*a* on actuator 14 and shaft 18*a* on actuator 18. The electrical actuators 14-18 enable power raising and lowering of the tower 10 and advantageously eliminate the need for additional structural supports, such as aft trailing arms, and enable a simplified tower structure. In certain embodiments, the electronic actuators 14-18 work in unison to smoothly transition the tower and roof frame structures between the erected orientation and the stowed orientation. The actuators 14-18 are electrically connected to a power supply, such as a battery of the boat B, and to a controller so that the actuators 14-18 may be operated in unison.

The tower 10 includes a leg 22 pivotally mounted to a base 24 on one side of the boat B and a leg 26 pivotally mounted to a base 28 on an opposite side of the boat B. The electrical leg actuator 14 is located in the base 24 and the electrical leg actuator 16 is located in the base 28. The base 24 is mounted on one side of the boat B and the base 28 is mounted on an opposite side of the boat B. The actuators 14/16 located in the bases 24/28 are connected to the legs 22/26 to pivotally raise or lower the legs 22/26 relative to the bases 24/28.

Figure 2:
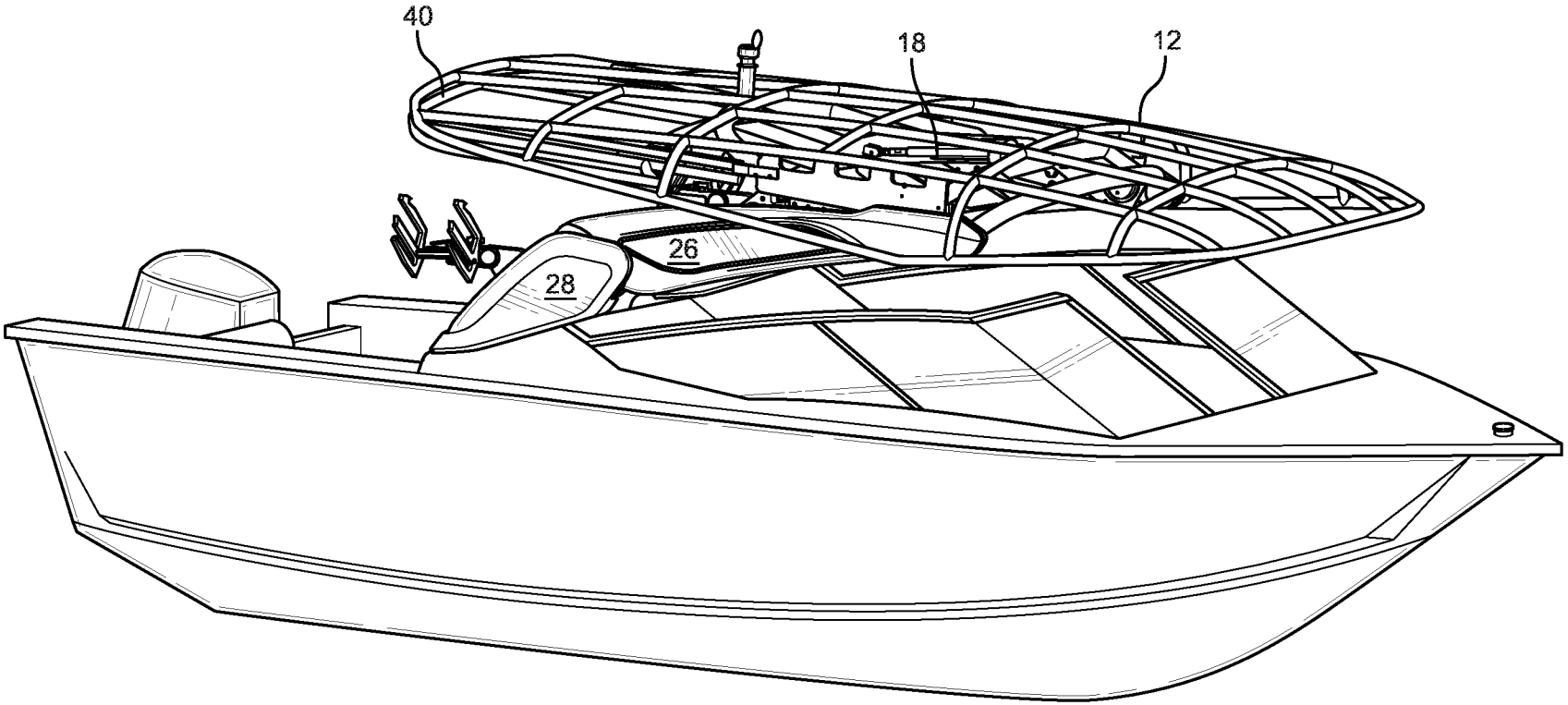
FIG. 2 shows the foldable water sports tower on the boat in a stowed or lowered orientation.

For example, FIG. 1 shows the tower 10 elevated with the legs 22/26 substantially upright relative to the bases 24/28. FIG. 2 shows the tower 10 lowered with the legs 22/26 pivoted downward and forward from the upright position.

Figure 3:
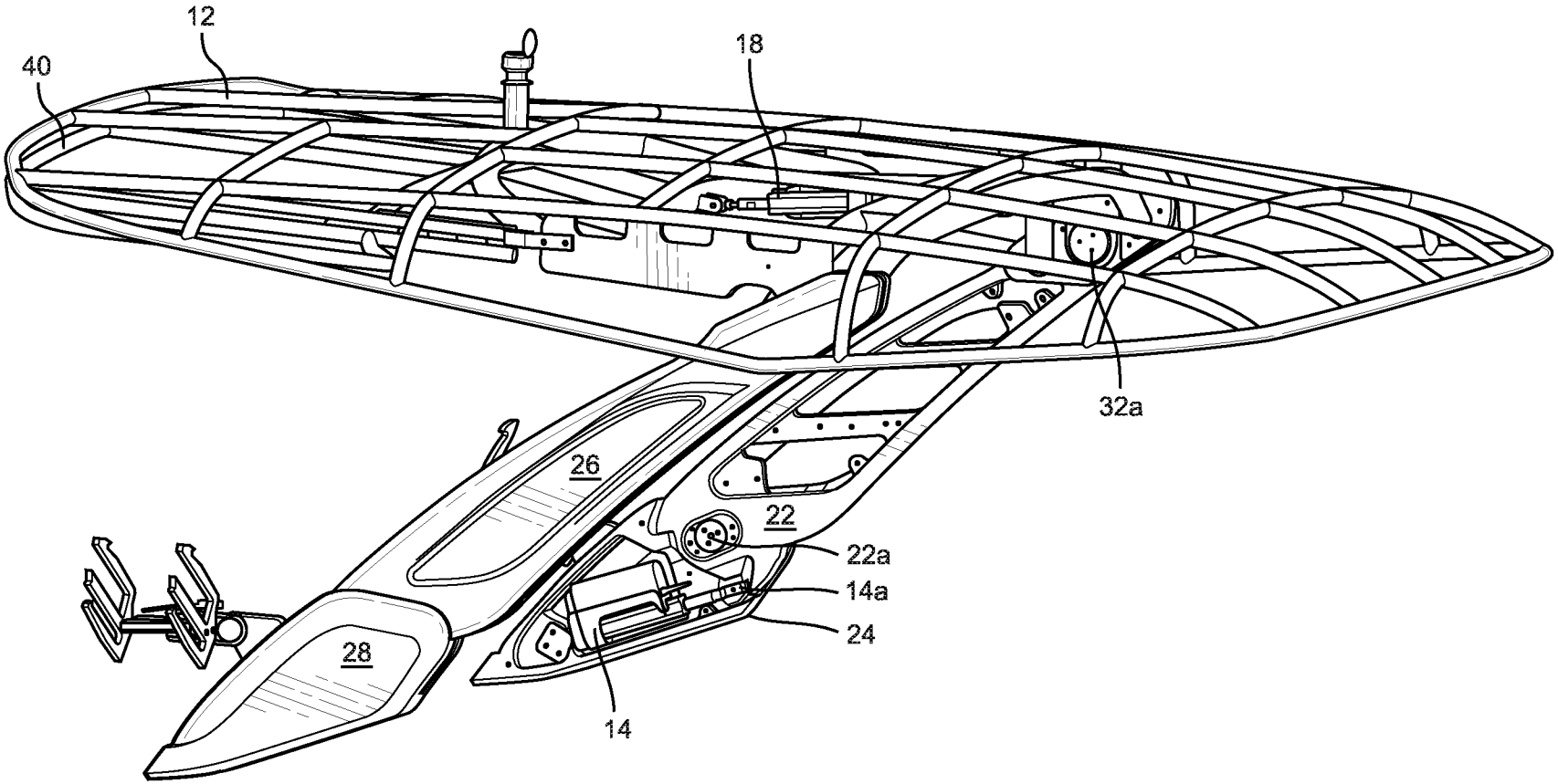
FIG. 3 shows the foldable watersports tower in the erected orientation without the boat.
Figure 4:
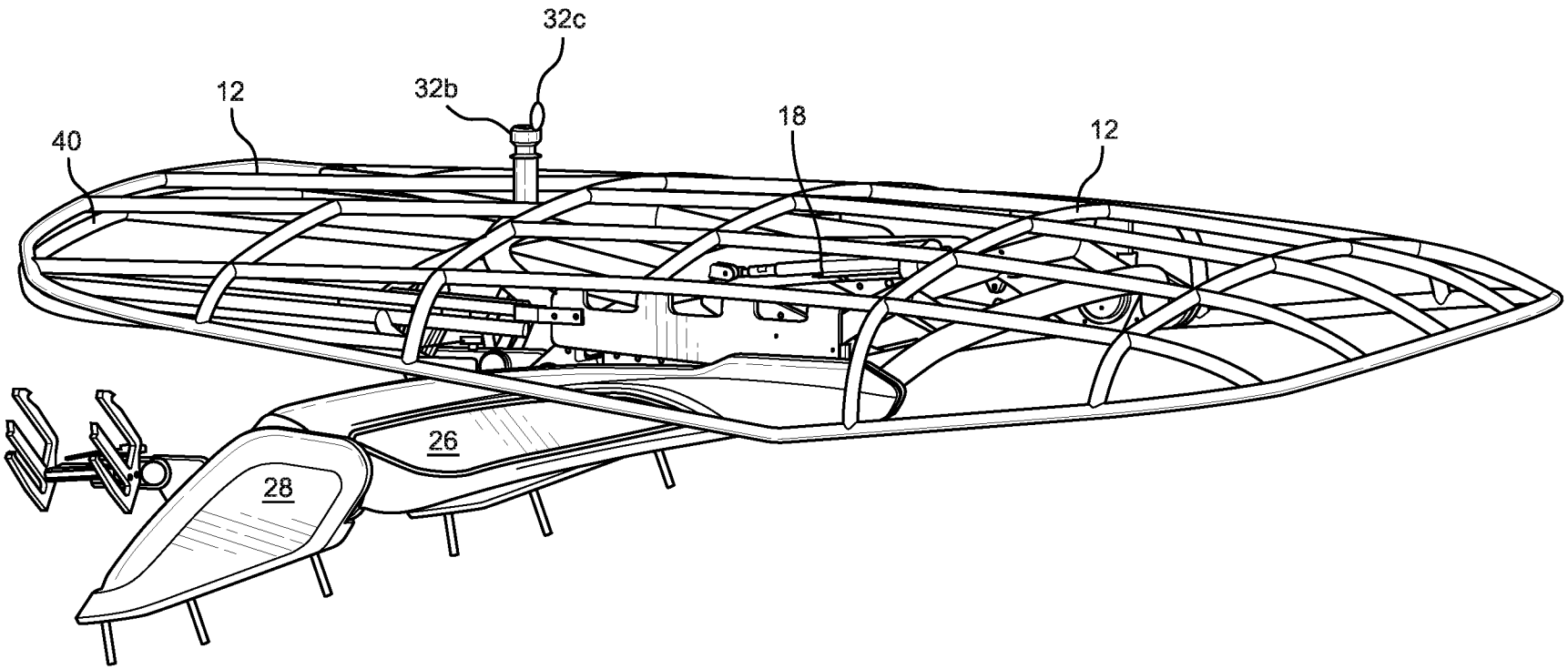
FIG. 4 shows the foldable watersports tower in the stowed orientation without the boat.
Figure 5:
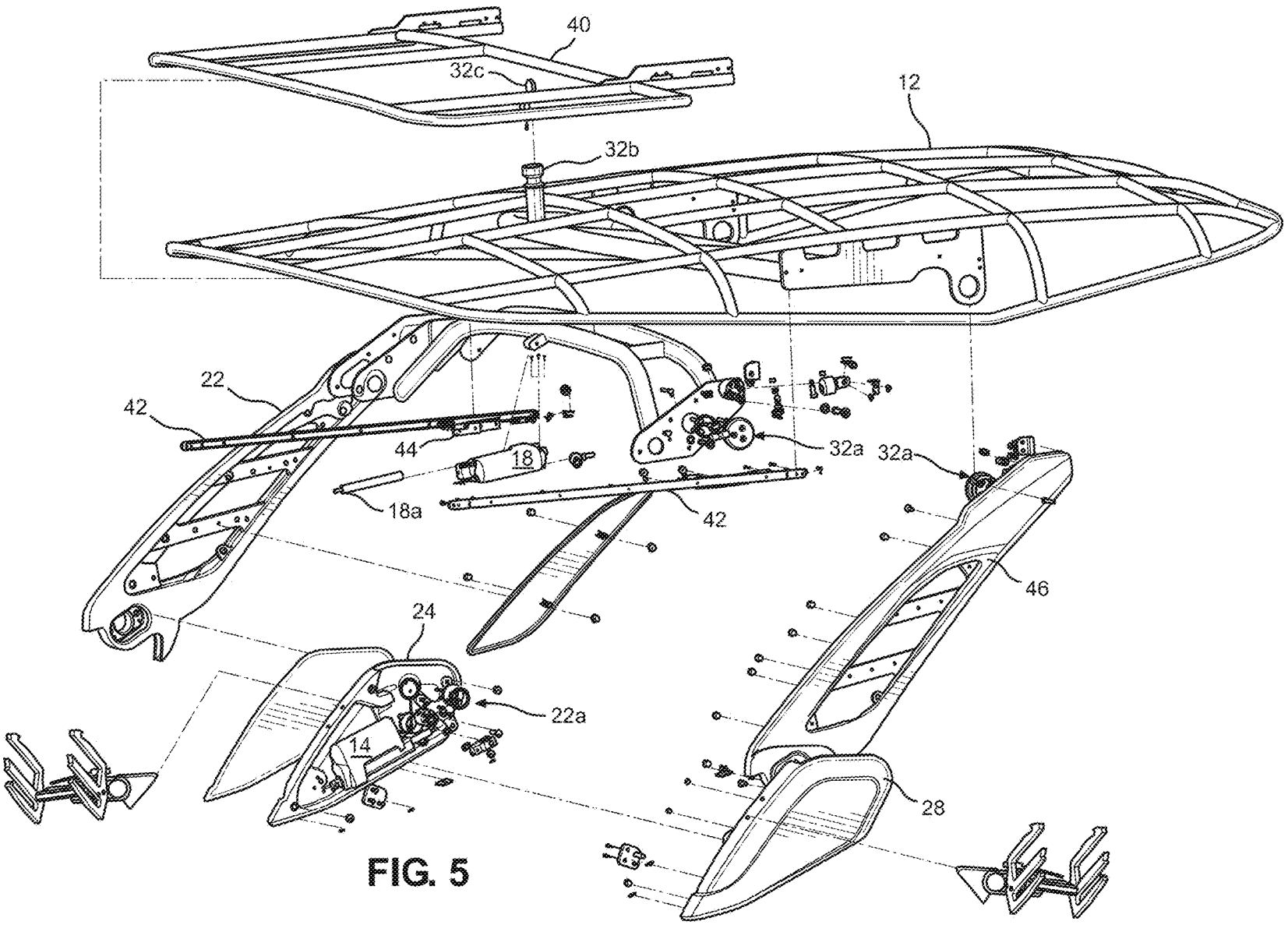
FIG. 5 is an exploded view of the foldable watersports tower.

As shown in FIG. 3, the leg 22 is pivotally connected to the base 24 as by a pivot connection 22*a*. A distal end of the shaft 14*a* of the actuator 14 is connected to a lower proximal portion of the leg 22. Thus, as the shaft 14*a* is extended, the leg 22 pivots forward and lowers. As the shaft 14*a* retracts, the leg 22 pivots rearward and raises. The leg 26 is operatively connected to the base 28 and actuator 16 in the same manner. Thus, since the actuators 14 and 16 operate in unison, the legs 22 and 26 raise and lower in unison.

An elevated cross-piece 30 extends between the upper ends of the legs 22 and 26 in the manner of an arch. The cross-piece 30 is statically mounted to the upper ends of the legs 22 and 26. A roof mount 32 is pivotally mounted to the upper ends of the legs 22 and 26 at pivot connections 32*a* and extends rearward of the cross-piece 30. The roof mount may include an upstanding tow point 32*b*, along with a nautical illumination device 32*c*, which may be included with the tow point 32*b*. In other embodiments, a tow point may be included on the cross-piece 30. As shown, the roof mount 32 has lateral members 34 and cross-members 36 that span between the lateral members 34. The lateral members 34 are configured for mounting at the pivot connections 32*a* and for attachment of the roof frame 12 thereto.

Figure 6:
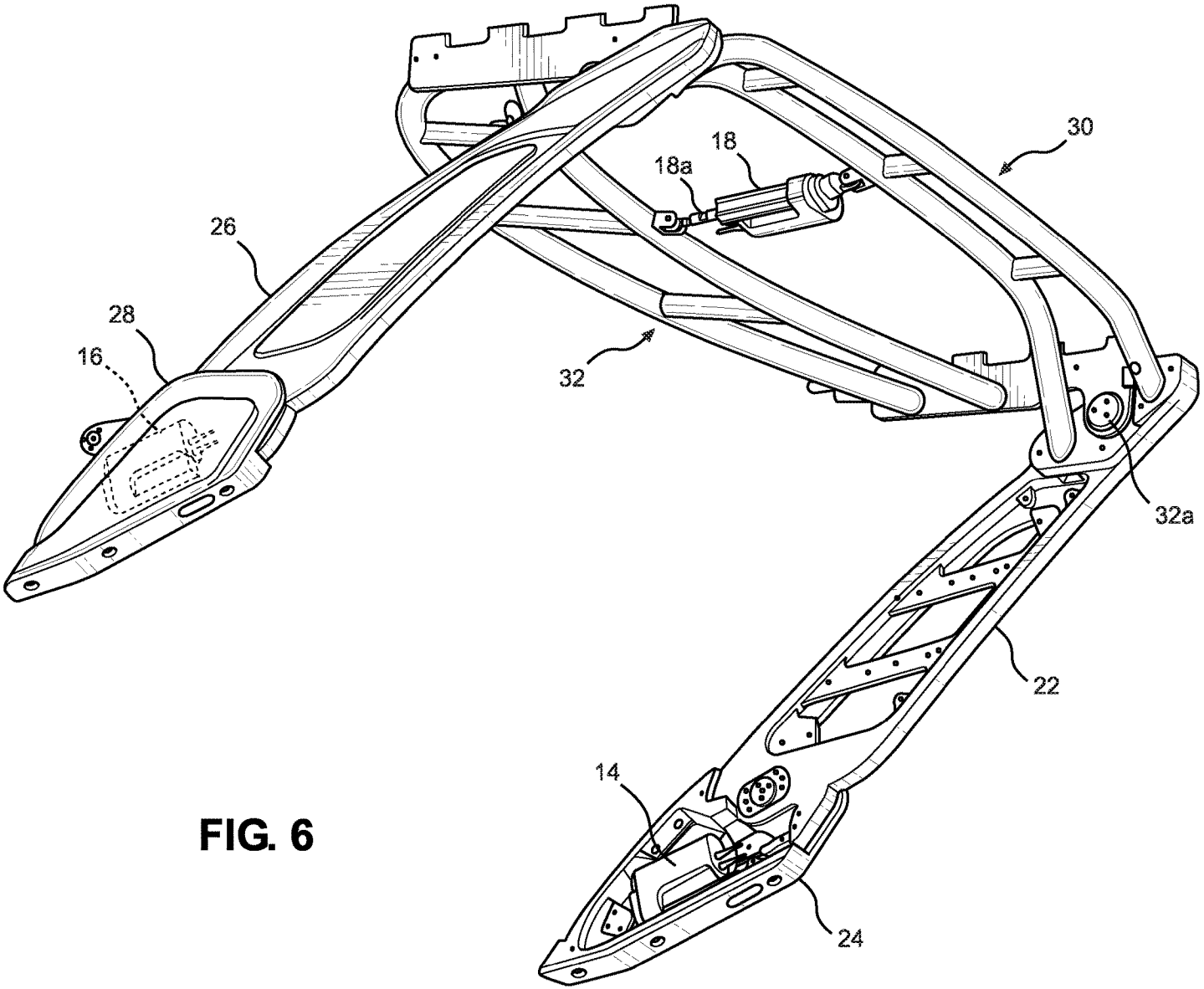
FIGS. 6 and 7 show components of the tower that support the roof frame and cooperate and rotate when going between the raised and lowered orientations of the roof frame.
Figure 7:
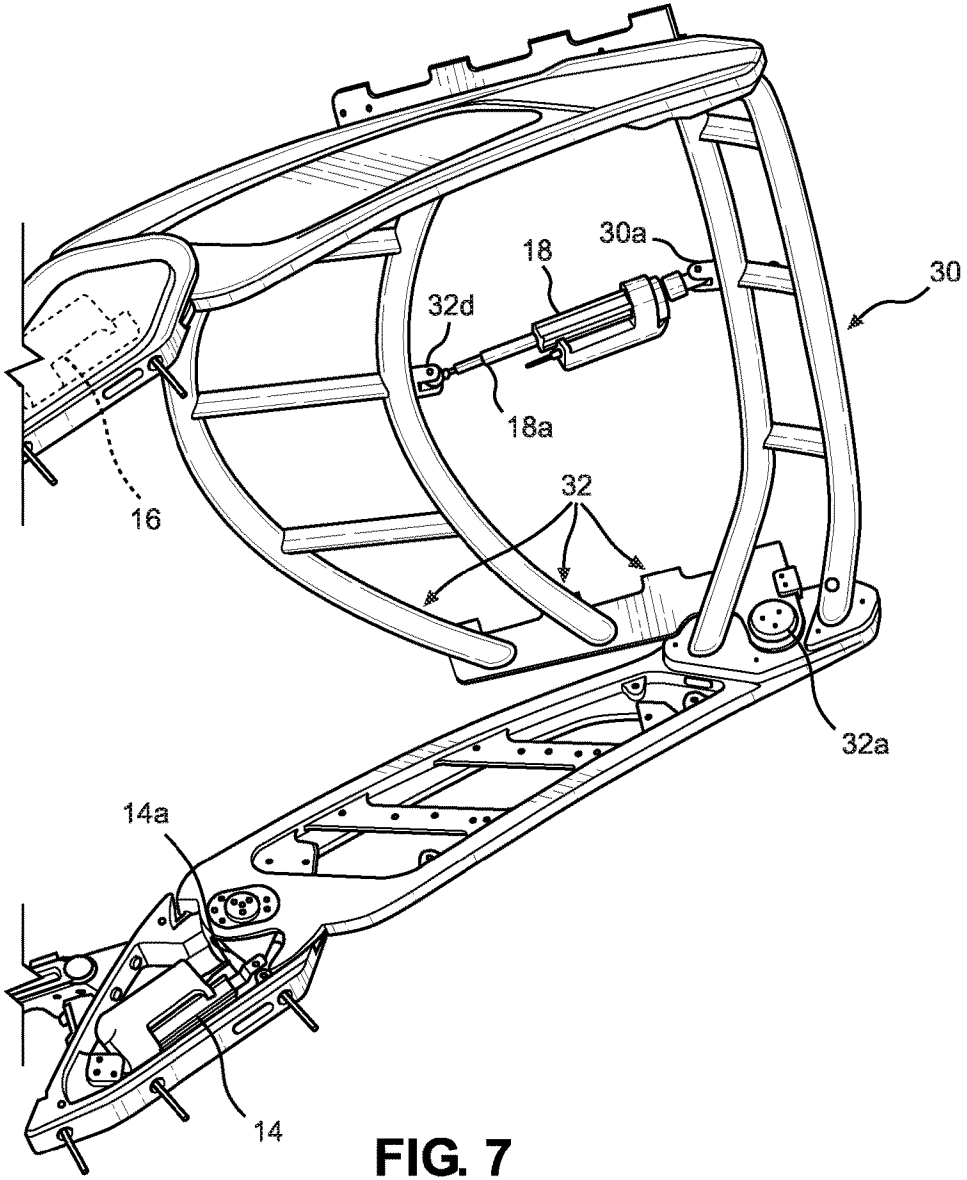

The electrical roof frame actuator 18 is connected between portions of the cross-piece 30 and portions of the roof mount 32. For example, with reference to FIGS. 6 and 7, the actuator 18 is mounted to the cross-piece 30 by a pivoting connection 30*a* proximate the middle of a rear edge of the cross-piece 30. The actuator 18 is mounted to the roof mount 32 by a pivoting connection 32*d* proximate the middle of a forward edge of the roof mount 32. Thus, as the shaft 18*a* is retracted, the roof mount 32 pivots forward and raises. As the shaft 14*a* extends, the roof mount 32 pivots rearward and lowers. Thus, when the actuators 14-18 operate in unison, the legs 22 and 26 raise and lower in unison, with the roof mount 32 also raising and lowering in unison. That is, as the legs 22/26 raise, the roof mount 32 raises. Likewise, as the legs 22/26 lower, the roof mount 32 lowers. FIG. 6 shows the roof mount 32 raised and FIG. 7 shows the roof mount lowered.

In certain embodiments, actuator 18 may operate independently of actuators 14 and 16. For example, when the tower is in an erected orientation, the shaft 18*a* of actuator 18 may be extended such that the roof mount 32 pivots rearward and lowers the rear of the roof frame 12. Thus, a user may be provided easier access to the top of the roof frame, such as for cleaning or to retrieve items stored on top of the roof frame 12.

Another feature of the tower 10 is the provision of an auxiliary roof frame 40 slidingly integrated into the underside of the roof frame 12 for simple and quick deployment and stowing. The auxiliary roof frame 40 is manually operated and independent of the operation of the actuators 14-18. The auxiliary roof frame 40 is located to be just below the roof frame 12.

Figure 8:
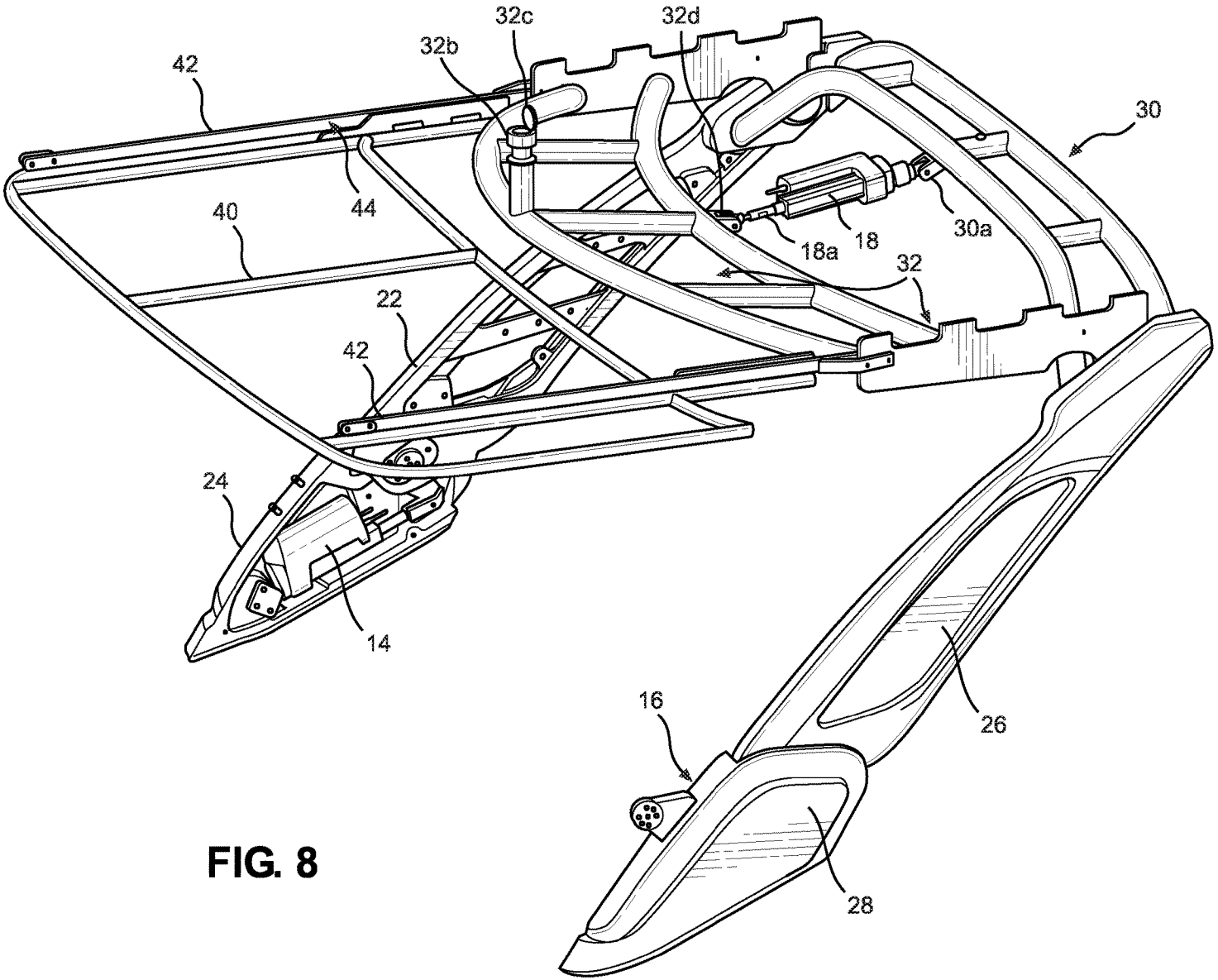
FIGS. 8 and 9 show a rear auxiliary roof section that can be mounted on the roof frame and slides in for storage and slides out for extending the roof.
Figure 9:
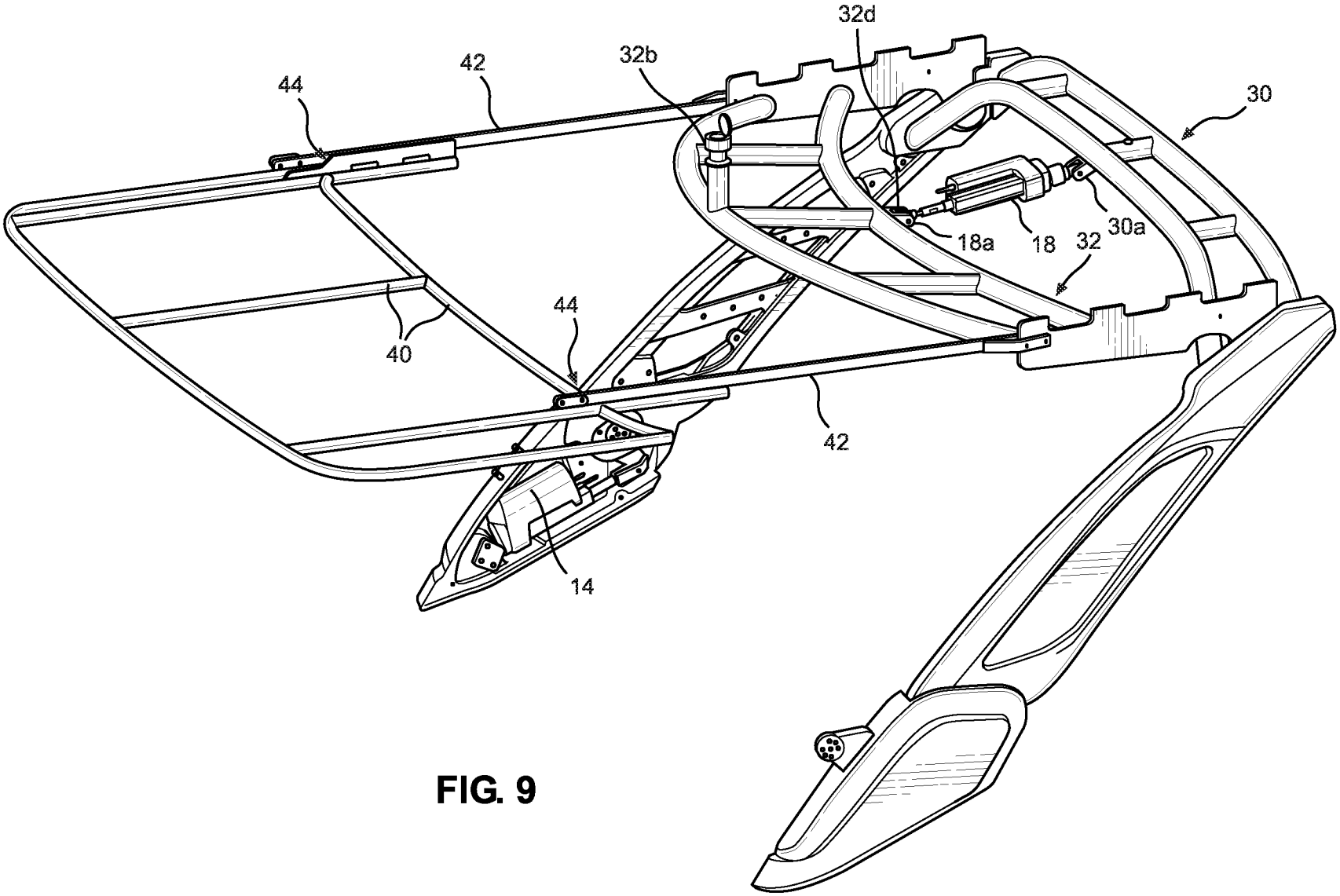

The auxiliary roof frame 40 is shown retracted in FIG. 8, and extended in FIG. 9. A track 42 is rigidly attached to the roof mount 32. A slide 44 is slidingly disposed within the track 42 and connected to the auxiliary roof frame 40. The track 42 includes stops to limit travel of the slide 44. Also, latches, locks, or the like may be incorporated to secure the slide 44 at a desired degree of extension or retraction. To extend the auxiliary roof frame 40, the slide 44 is moved in a direction away from the roof mount 32. To retract the auxiliary frame 40, the slide is moved toward the roof mount 32.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated.

The invention claimed is:

1. A foldable watersports tower for a boat includes:

a pair of legs pivotally mounted to the boat, each leg having an electronic leg actuator operable to pivot the leg between an upright orientation and a lower orientation;

a cross-piece extending between the legs;

a roof pivotally mounted to the legs, the roof comprising a roof mount pivotally mounted to the legs and extending rearward of the cross-piece and a roof frame statically mounted to the roof mount; and an electronic roof actuator connected between portions of the cross-piece and portions of the roof, with a first end of the roof actuator pivotally attached to the cross-piece and a second end of the roof actuator pivotally attached to the roof mount.

2. The foldable watersports tower of claim 1, wherein the first end of the roof actuator is pivotally attached to the cross-piece proximate the middle of a cross-piece rear edge.

3. The foldable watersports tower of claim 1, wherein the second end of the roof actuator is pivotally attached to the roof mount proximate the middle of a roof mount forward edge.

4. The foldable watersports tower of claim 1, wherein the leg actuators and the roof actuator are operable in unison to raise and lower the roof.

5. The foldable watersports tower of claim 1, wherein the tower is operable so that the roof maintains a substantially constant attitude between a raised position and a lowered position.

6. The foldable watersports tower of claim 1, wherein the roof actuator is operable to lower a rear portion of the roof when the tower is in the raised position.

7. The foldable watersports tower of claim 1, wherein the cross-piece is statically mounted to upper ends of the legs.

8. The foldable watersports tower of claim 1, wherein the roof is pivotally mounted to upper ends of the legs.

9. The foldable watersports tower of claim 1, further comprising an auxiliary roof frame slidingly mounted to the roof and positionable to be extended or retracted relative to the roof.

10. A foldable watersports tower for a boat includes:

a pair of legs pivotally mounted to the boat, each leg having an electronic leg actuator operable to pivot the leg between an upright orientation and a lower orientation;

a cross-piece extending between and statically mounted to upper ends of the legs;

a roof comprising a roof mount pivotally mounted to upper ends of the legs and extending rearward of the cross-piece and a roof frame statically mounted to the roof mount; and an electronic roof actuator with a first end pivotally connected to the cross-piece and a second end pivotally connected to the roof mount;

wherein the leg actuators and the roof actuator are operable in unison to raise and lower the roof so that the roof maintains a substantially constant attitude between a raised position and a lowered position.

11. The foldable watersports tower of claim 10, further comprising an auxiliary roof frame slidingly mounted to the roof and positionable to be extended or retracted relative to the roof.

12. The foldable watersports tower of claim 10, wherein the roof actuator is operable to lower a rear portion of the roof when the tower is in the raised position.

* * * * *